US008696154B2

(12) United States Patent
Hutchens

(10) Patent No.: US 8,696,154 B2
(45) Date of Patent: Apr. 15, 2014

(54) LUMINAIRES AND LIGHTING STRUCTURES

(75) Inventor: Daniel C. Hutchens, Cold Spring, KY (US)

(73) Assignee: LSI Industries, Inc., Cincinnati, OH (US)

( * ) Notice: Subject to any disclaimer, the term of this patent is extended or adjusted under 35 U.S.C. 154(b) by 426 days.

(21) Appl. No.: 13/213,282

(22) Filed: Aug. 19, 2011

(65) Prior Publication Data

US 2013/0044475 A1 Feb. 21, 2013

(51) Int. Cl.
*F21V 7/00* (2006.01)

(52) U.S. Cl.
USPC ..... 362/217.05; 362/217.07; 362/245; 362/299; 362/296.05; 362/343

(58) Field of Classification Search
USPC ..... 362/217.05, 217.07, 223, 245, 362/308–310, 296.05, 296.07, 311.02, 328, 362/329, 343, 346, 235
See application file for complete search history.

(56) References Cited

U.S. PATENT DOCUMENTS

| | | | |
|---|---|---|---|
| 1,563,102 | A | 11/1925 | Osburn |
| 2,356,654 | A | 8/1944 | Cullman |
| 2,418,195 | A | 4/1947 | Rolph |
| 2,525,553 | A | 10/1950 | Kingston et al. |
| 2,525,556 | A | 10/1950 | Marchisio |
| 2,913,575 | A | 11/1959 | Lipscomb |
| 3,248,533 | A | 4/1966 | Mathis |
| D207,596 | S | 5/1967 | Wince |
| 3,600,569 | A | 8/1971 | Matteson |
| 3,803,401 | A | 4/1974 | Drews |
| 4,007,365 | A | 2/1977 | Stempfle et al. |
| 4,161,014 | A | 7/1979 | Dey et al. |
| 4,320,442 | A | 3/1982 | McCamy |
| 4,342,071 | A | 7/1982 | Chamberlain |
| 4,358,816 | A | 11/1982 | Soileau |
| 4,425,603 | A | 1/1984 | Courson |
| 4,507,717 | A | 3/1985 | Wijbenga |
| 4,536,828 | A | 8/1985 | Mori |
| 4,599,684 | A | 7/1986 | Lee |
| 4,641,226 | A | 2/1987 | Kratz |

(Continued)

FOREIGN PATENT DOCUMENTS

| | | |
|---|---|---|
| EP | 2051001 | 4/2009 |
| WO | WO 99/09349 | 2/1999 |

OTHER PUBLICATIONS

International Search Report and the Written Opinion dated Aug. 24, 2012 for Corresponding PCT Application No. PCT/US2012/043948.

(Continued)

*Primary Examiner* — Stephen F Husar
(74) *Attorney, Agent, or Firm* — McDermott Will & Emery LLP

(57) ABSTRACT

Luminaires are disclosed that include refractive and/or reflective structures that can provide or distribute lighting for a given area with high uniformity and efficiency. The structures can be used to distribute light from one or more light sources for lighting target areas with a desired light distribution. The lighting structures can be included in light strips or luminaires. Such luminaire can be utilized in place of fluorescent lights and can facilitate quick and easy retrofit for previous fluorescent lighting applications. The disclosed techniques and systems (including components and structures) can be particularly useful when employing one or more LEDs as light sources.

24 Claims, 7 Drawing Sheets

(56) References Cited

U.S. PATENT DOCUMENTS

| | | | | |
|---|---|---|---|---|
| 4,694,382 | A | 9/1987 | Sales | |
| 4,811,179 | A | 3/1989 | Komatsu et al. | |
| 4,847,734 | A | 7/1989 | Katoh et al. | |
| D316,613 | S | 4/1991 | Stein | |
| 5,016,146 | A | 5/1991 | Kaspar | |
| 5,274,533 | A | 12/1993 | Neary et al. | |
| 5,278,731 | A | 1/1994 | Davenport et al. | |
| 5,438,485 | A | 8/1995 | Li et al. | |
| 5,471,372 | A | 11/1995 | Mamelson et al. | |
| 5,539,623 | A | 7/1996 | Gurz et al. | |
| 5,561,346 | A | 10/1996 | Byrne | |
| 5,567,031 | A | 10/1996 | Davenport et al. | |
| 5,582,480 | A | 12/1996 | Zwick et al. | |
| 5,954,421 | A | 9/1999 | McGrath | |
| 6,053,624 | A | 4/2000 | Cronk | |
| 6,206,548 | B1 | 3/2001 | Lassovsky | |
| 6,283,612 | B1 | 9/2001 | Hunter | |
| 6,435,701 | B1 | 8/2002 | Chen | |
| 6,474,848 | B1 | 11/2002 | Lahner et al. | |
| 6,558,032 | B2 * | 5/2003 | Kondo et al. | 362/346 |
| 6,578,979 | B2 | 6/2003 | Truttmann-Battig | |
| 6,601,976 | B1 | 8/2003 | Rhee | |
| 6,607,289 | B2 | 8/2003 | Lassovsky | |
| 6,641,284 | B2 | 11/2003 | Stopa et al. | |
| 6,705,744 | B2 | 3/2004 | Hubbell et al. | |
| 6,783,263 | B1 | 8/2004 | Cronk | |
| 6,805,470 | B1 | 10/2004 | Ward | |
| 6,818,864 | B2 | 11/2004 | Ptak | |
| 6,851,834 | B2 | 2/2005 | Leysath | |
| 6,871,981 | B2 | 3/2005 | Alexanderson et al. | |
| 6,871,993 | B2 | 3/2005 | Hecht | |
| 6,893,140 | B2 | 5/2005 | Storey et al. | |
| 7,021,806 | B2 | 4/2006 | Ovenshire | |
| 7,049,761 | B2 | 5/2006 | Timmermans et al. | |
| 7,090,370 | B2 | 8/2006 | Clark et al. | |
| 7,121,675 | B2 | 10/2006 | Ter-Hovhannisian | |
| 7,156,539 | B2 | 1/2007 | Cronk | |
| 7,173,216 | B2 | 2/2007 | Ptak | |
| 7,222,992 | B2 | 5/2007 | Holten et al. | |
| 7,275,841 | B2 | 10/2007 | Kelly | |
| 7,293,908 | B2 | 11/2007 | Beeson et al. | |
| 7,312,560 | B2 | 12/2007 | Ouderkirk et al. | |
| 7,364,322 | B2 | 4/2008 | Oppor et al. | |
| 7,407,307 | B2 | 8/2008 | Hiratsuka | |
| 7,422,347 | B2 | 9/2008 | Miyairi et al. | |
| 7,461,960 | B2 | 12/2008 | Opolka et al. | |
| 7,497,600 | B2 | 3/2009 | Sekela et al. | |
| 7,510,299 | B2 | 3/2009 | Timmermans et al. | |
| 7,513,637 | B2 | 4/2009 | Kelly et al. | |
| 7,513,639 | B2 | 4/2009 | Wang | |
| 7,562,990 | B2 | 7/2009 | Maeda et al. | |
| D617,937 | S | 6/2010 | Farmer et al. | |
| 7,766,497 | B2 | 8/2010 | Sommers et al. | |
| 7,828,456 | B2 | 11/2010 | Boyer et al. | |
| 7,871,176 | B2 | 1/2011 | Kelly et al. | |
| 2004/0188593 | A1 | 9/2004 | Mullins et al. | |
| 2005/0265019 | A1 | 12/2005 | Sommers et al. | |
| 2005/0265023 | A1 | 12/2005 | Scholl | |
| 2005/0265035 | A1 | 12/2005 | Brass et al. | |
| 2006/0221606 | A1 | 10/2006 | Dowling | |
| 2006/0285325 | A1 | 12/2006 | Duchame et al. | |
| 2007/0047229 | A1 | 3/2007 | Lee | |
| 2007/0159820 | A1 | 7/2007 | Crandell et al. | |
| 2007/0195535 | A1 | 8/2007 | Artwohl et al. | |
| 2007/0228999 | A1 | 10/2007 | Kit | |
| 2007/0230171 | A1 | 10/2007 | Hiratsuka | |
| 2007/0268698 | A1 | 11/2007 | Chen et al. | |
| 2007/0274067 | A1 | 11/2007 | Sloan et al. | |
| 2008/0037239 | A1 | 2/2008 | Thomas et al. | |
| 2008/0088770 | A1 | 4/2008 | Hwang et al. | |
| 2008/0094834 | A1 | 4/2008 | Li et al. | |
| 2008/0112161 | A1 | 5/2008 | Summers et al. | |
| 2008/0198600 | A1 | 8/2008 | Crandell et al. | |
| 2008/0219002 | A1 | 9/2008 | Sommers et al. | |
| 2008/0298058 | A1 | 12/2008 | Kan et al. | |
| 2009/0103288 | A1 | 4/2009 | Boyer et al. | |
| 2009/0219713 | A1 | 9/2009 | Siemiet et al. | |
| 2009/0237950 | A1 | 9/2009 | Ying | |
| 2010/0027269 | A1 | 2/2010 | Lo et al. | |
| 2010/0177532 | A1 | 7/2010 | Simon et al. | |
| 2010/0214769 | A1 | 8/2010 | Bhargava et al. | |
| 2010/0309647 | A1 | 12/2010 | Winkler et al. | |
| 2011/0110081 | A1 | 5/2011 | Belknap et al. | |

OTHER PUBLICATIONS

International Search Report and the Written Opinion for Corresponding PCT Application No. PCT/US09/32083, mailed Mar. 10, 2009.

* cited by examiner

LUMINAIRES AND LIGHTING STRUCTURES

FIELD OF THE DISCLOSURE

The present disclosure is directed generally to the use of light sources. More particularly the present disclosure is directed to lighting structures that include reflective and refractive elements that can be used to distribute light from one or more light sources in desired directions.

BACKGROUND OF THE DISCLOSURE

Different strategies have been designed to provide uniform and efficient light distribution over a given area. For example, display cases are commonly used in retail applications, such as the refrigerated cases in supermarkets and convenience stores, to display merchandise and are commonly arranged into banks of shelving displays or showcase displays for holding goods. Typically, such display cases are illuminated by fluorescent light fixtures. While providing certain benefits over incandescent lighting, fluorescent lights themselves have inherent power and maintenance requirements and related costs. Fluorescent lights also contain mercury causing substantial environmental concerns and costs.

Certain techniques have been employed to install alternate sources of lighting in place of fluorescent lights. Such techniques typically require contemporaneous altering of the structural support adjacent to the fluorescent light fixtures, such as by drilling holes. For applications including refrigerated food and beverage displays, such techniques can lead to unnecessary wasted cooling energy, excess labor, and possibly spoiling of the refrigerated items themselves as well as costs related to each.

Light emitting diodes (LEDs) have been used in various applications where incandescent or fluorescent lights have been used. Because individual LEDs are essentially point light sources, as opposed to continuous elements, such as incandescent and fluorescent lights, lighting uniformity has proven challenging to achieve for many applications.

SUMMARY OF THE DISCLOSURE

The present disclosure is directed to lighting structures including refractive and/or reflective structures that can provide or distribute lighting for a given area with high uniformity and efficiency. The lighting structures can include a reflector, configured to reflect light from an adjacent light source, the reflector defining one or more apertures configured to allow light from the light source to pass therethrough. The structures can be used to distribute light from one or more light sources for lighting target areas with a desired light distribution. Other aspects, embodiments, and details of the present disclosure will be apparent from the following description when read together with the accompanying drawings.

The lighting structures can be included in light strips or luminaires. Such light strips or luminaires can be utilized in place of fluorescent lights and can facilitate quick and easy retrofit for previous fluorescent lighting applications. The disclosed techniques and systems (including components and structures) can be particularly useful when employing one or more LEDs or the like as light sources.

Light distribution structures according to the present disclosure can include a refractive element and a reflective element.

An exemplary embodiment can include a luminaire including any of the previously mentioned reflective elements or reflectors may be configured to reflect a first portion of light received from a light source in one or more desired directions and to allow a second portion of light from the light source to pass therethrough in one or more desired directions; and a refractive element configured to receive one or both of the first and second portions of light and transmit both in desired directions.

Another exemplary embodiment can include a luminaire having a light source for emitting light, a reflector having a first side and a second side, the reflector configured and situated such that a first portion of the light emitted by the light source passes through the reflector from the first side to the second side, and a second portion of the light emitted by the light source is reflected by the first side of the reflector. The luminaire can be configured such the first portion of light emitted by the light source passes through an aperture defined in the reflector. The reflector may optionally be generally V-shaped and the luminaire may be configured such that the light source is situated adjacent to the vertex of the V-shaped reflector. The reflector may optionally be generally V-shaped and the luminaire and the first portion of light emitted by the light source may be configured such that the first portion of light passes through an aperture defined approximately at the vertex of the V-shaped reflector. The luminaire may be configured such that a third portion of light emitted by the light source does not pass through the reflector and is not reflected by the first side of the reflector. The luminaire may optionally comprise a second light source wherein a first portion of light emitted by the second light source passes through the aperture defined in the reflector. The luminaire may also optionally comprise a refractor lens having a central lens portion configured to receive at least a portion of the first portion of light emitted by the light source and the central lens portion may optionally be contoured to refract light.

BRIEF DESCRIPTION OF THE DRAWINGS

Aspects and embodiments of the present disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
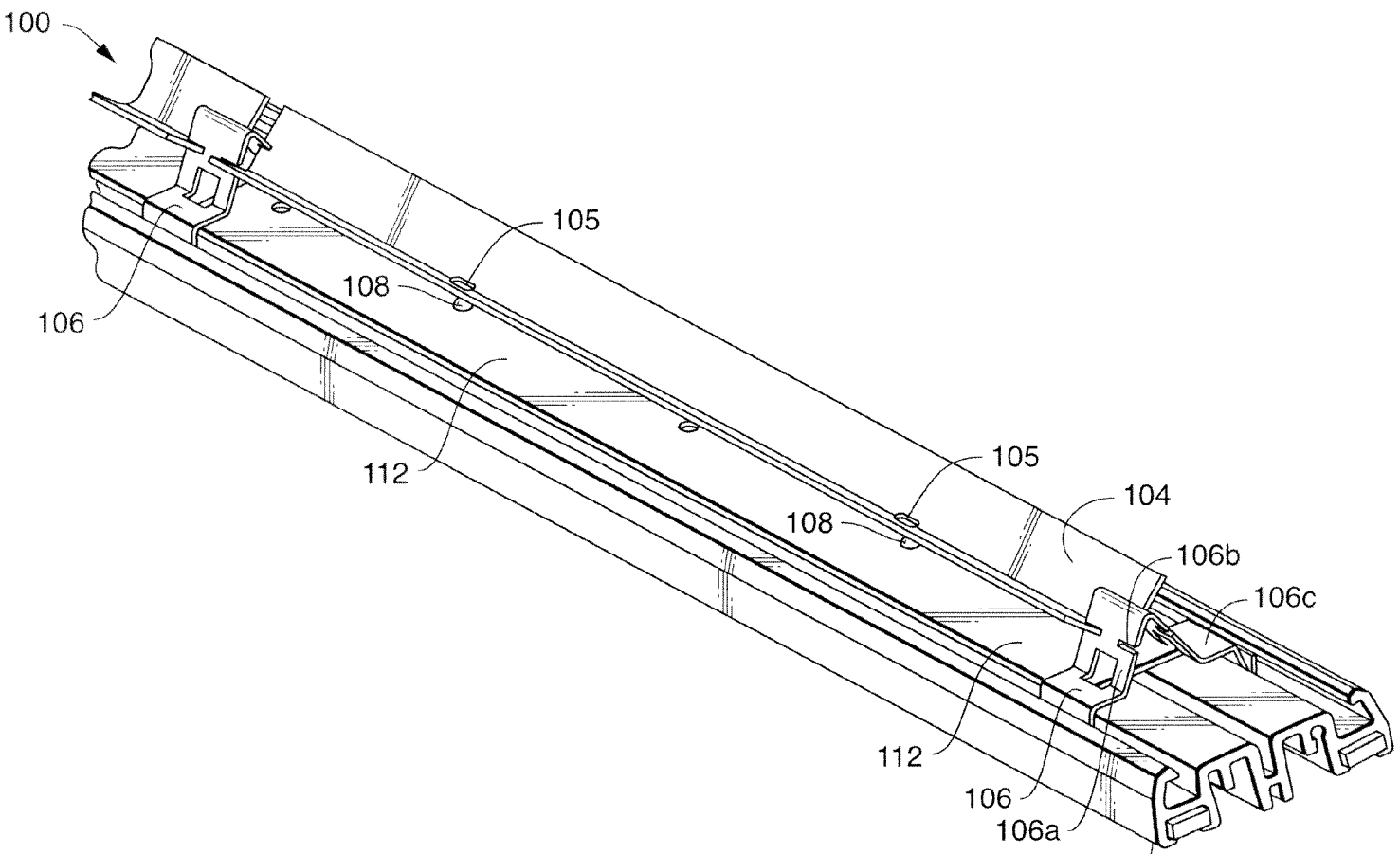
FIG. 1 depicts a perspective view of a portion of an example of a luminaire, in accordance with the present disclosure.

The embodiments depicted in the drawing are merely illustrative. Variations of the embodiments shown in the drawings, including embodiments described herein, but not depicted in the drawings, may be envisioned and practiced within the scope of the present disclosure.

DETAILED DESCRIPTION

Aspects and embodiments of the present disclosure provide luminaires and lighting structures. Luminaires according to the present disclosure can be used for new installations or to retro-fit existing lighting assemblies and applications, such as those that utilize fluorescent lighting. Use of such lighting techniques can afford reduced energy and maintenance as well as reduced installation time and costs when compared to existing techniques.

In exemplary embodiments, alternative light sources to fluorescent lights may be utilized. While the preferred embodiment employs LEDs as light sources, other light sources may also be employed or alternatively used within the scope of the present disclosure. By way of example only, other light sources such as plasma light sources may be used. Further, the term "LEDs" is intended to refer to all types of light emitting diodes including organic light emitting diodes or "OLEDs".

While the luminaire depicted in the Figures is generally applicable to any application that would benefit from strip lighting, it is well-suited, in one example, for application to display cases where the luminaire can be mounted to various of the elongated structural elements of the display case to be hidden from the view of customers viewing items in the display case. One exemplary application is refrigerated food cases such as those commonly found in supermarkets and convenience stores. The depicted luminaire lends itself to application in food cases because its elongated structure facilitates mounting to mullions between doors permitting access to the food case. Such refrigerated cases, can include cases for chilled foods and/or drinks, as well as those used to display frozen foods. Other embodiments may be particularly well-suited for use in display cases for displaying non-food items, e.g., those used to display merchandise goods such as jewelry, watches, and the like. Use in such non-food display cases is advantageous because of the luminaires ability to be mounted to various of the elongated structural components of the display case to illuminate the display case while remaining at least mostly hidden from view of those persons viewing items in the display case. As will be discussed below, the reflector of the present disclosure, while elongated, is applicable to other luminaires such as by using multiple of these reflectors to guide the light from various matrices of light sources.

FIG. 1 depicts a perspective view of a portion of an example of a luminaire 100, in accordance with the present disclosure. Luminaire 100 may include a reflective element (or reflector) 104 (e.g., a V-shaped element as shown), which has one or more apertures 105 defined at its vertex. The one or more apertures 105 are configured to pass some of the light emitted from one or more light sources 108 (e.g., LEDs) associated therewith. One or more reflector mounting structures 106 (e.g., spring clips) may hold the reflective element 104 relative to the light sources 108 depicted as LEDs mounted or formed on a printed circuit board ("PCB") 112 supported on a frame 114. The frame 114 may have any suitable size, shape and cross-sectional configuration. Any suitable materials may be used for the described components. Luminaire 100 may, optionally, be used with or include a lens or refractive element such as that described and/or shown in the figures herein.

Figure 2:
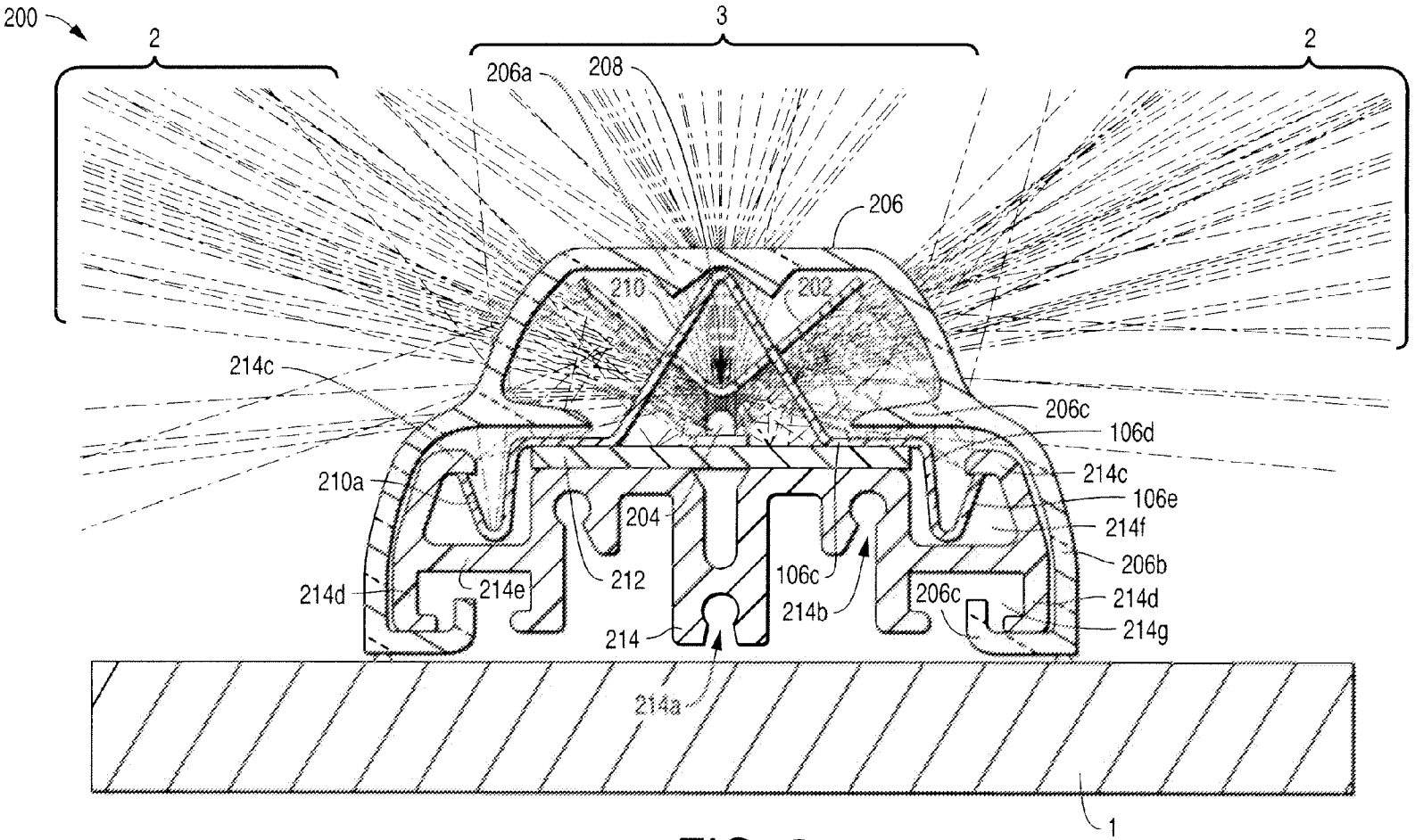
FIG. 2 depicts a cross section of another example of a luminaire including light ray traces, in accordance with the present disclosure.

In operation while the one or more light sources 108 of the luminaire 100 depicted in FIG. 1 are producing light, a first portion of light from each individual light source 108 passes through an associated aperture 105 and a second portion of light is directed laterally relative to the luminaire 100; some of which passes directly as emitted from the light source 108 and some of which is reflected by the reflective element 104 after being emitted from the light source 108, e.g., as shown and described for FIG. 2.

FIG. 2 depicts a cross section of another exemplary luminaire in accordance with the present disclosure. Luminaire 200 may include a reflector or reflective element 202 and one or more suitable light sources (e.g., LEDs) 204. A lens or refractive element 206 may also be included. The reflective element 202 defines one or more apertures 208 that are configured to permit passage of a portion of light from the one or more light sources 204. One or more reflector mounting structures (e.g., spring clips) 210 hold the reflective element 202 relative to the associated light source 204 mounted on or part of a PCB 212 and the PCB 212 is situated on a frame 214. FIG. 2 depicts an arbitrary structure 1 to which the luminaire 200 is mounted.

Light emanating from the one or more light sources travels though the refractive element in accordance with Snell's law. For ease of comprehension, light ray traces in the area indicated at reference numeral 3 indicates light passing through the depicted aperture 208 then the lens 206. Light ray traces in the two areas indicated at reference numeral 2, indicates light emanating from the one or more light sources 204 and passing laterally through the lens either directly from the light source 204 or after reflecting from the reflective element 202.

The lens or refractive element 206 may include a portion 206*a* that is configured to receive a portion of light from the one or more light sources 204 passing through the one or more apertures 208.

The reflector mounting structure 210, comprises the same configuration as the reflector mounting structure 106 shown in FIG. 1. In the embodiment of the reflector mounting structure 106, 210 depicted in FIGS. 1 and 2 is comprised of first and second receiving legs 106*a* joined at one end to form an inverted V. Each receiving leg 106*a* comprises receiving slots 106*b* on opposing sides to receive the reflector 104, 202 as shown. A mounting leg 106*c* extends from each of the receiving legs 106*a* for standing on the PCB 112, 212 and allowing the receiving slots 106*b* to hold the reflector 104, 202 apart from the PCB 112, 212. Springs clips formed by spring legs 106*d* and 106*e* extend from each mounting leg 106*c* as shown.

Frame 214 may have any desired shape. For example, frame 214 preferably includes one or more arms forming channels (214*a*, 214*b*) having a partially circular cross-section configured to receive fasteners such as screws, dowels, pins, or the like to assist with assembly or mounting of the luminaire 200. Frame 214 also preferably includes one or more arms (214*c*-214*e*), that are configured to receive and/or contact one or more respective portions of the luminaire 200. For example, in the embodiment depicted in FIG. 2, horizontal arm 214*e* extends outward from the remaining portions of the frame 214. Arm 214*c* extends upward from arm 214*e* and bends inward to define a mounting structure channel 214*f*. Each mounting structure channel 214*f* receives the spring legs 106*d* and 106*e* of the reflector mounting structure 106, 210 to secure the reflector mounting structure 210 to the frame 214. In one embodiment, the spring legs 106*d* and 106*e* are flexed to fit the spring clip they form into the mounting structure channel 214*f*. Once the spring clip formed by spring legs 106*d* and 106*e* on each side of the mounting structure 106, 210 are secured in their respective mounting structure channels 214*f*, the mounting structure 106, 210 is secured in place to the frame 114, 214. Furthermore, arm 214*d* extends downward from arm 214*e* to define a lens mounting channel 214*g* to receive a portion of the lens 206 to facilitate securement of the lens 206 to the frame 214, described in more detail below. In one embodiment, frame 214 is constructed by extrusion to provide the frame 214 with all required rigidity. The frame 214 may be constructed from any suitable material. Examples include, but are not limited to, anodized aluminum, chromed steel, plastic, and the like.

Figure 3A:
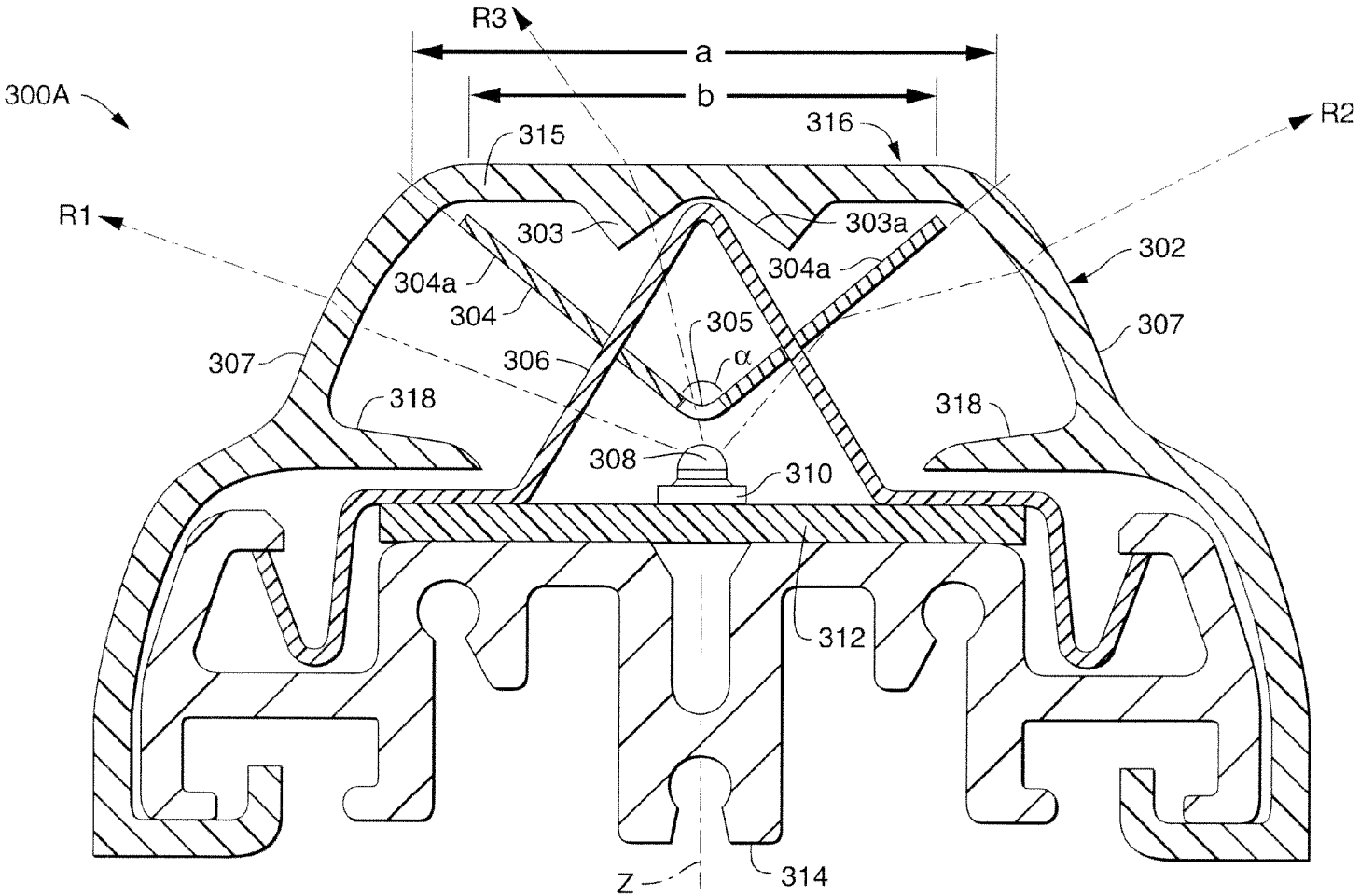
FIG. 3A depicts a cross sectional view of an exemplary embodiment of a luminaire.

FIG. 3A depicts a cross sectional view of an exemplary embodiment of a luminaire 300A, in accordance with the present disclosure. Luminaire 300A may include a refractor, or refractive element, 302. Refractor 302 may have a central lens portions 303 comprising variable thickness that is configured to distribute or refract light. The central lens portion 303 has a thickness profile and inner surface 303*a* to distribute light from a light source (e.g. LED) 308 in a desired distribution pattern. Refractor 302 may also be referred to as a means for refracting or a refractive means. Luminaire 300A may also include a reflective element or reflector 304. The refractive element 302 and the reflective element 304 may together or individually be referred to as light distribution means.

Continuing with the description of FIG. 3A, a mounting structure 306 may hold the reflector 304 relative to a frame 314 and the light source 308 mounted thereon. Frame 314 may be any suitable shape and may be made of any suitable material. For exemplary embodiments, frame 314 may be adapted to fit within the footprint of a pre-existing fluorescent light fixture and, optionally, use the same mounting holes or equipment as the pre-existing fluorescent light fixture to facilitate simple replacement of the pre-existing fluorescent light fixture with the light fixture of the present disclosure. One or more light elements or light sources 308 may be present (one is shown in FIG. 3A). The one or more light sources 308 may be positioned adjacent or on a supporting member, e.g., a PCB 312. For some applications, the one or more light sources may be enclosed in or disposed on a protective die or a mounting element. If one or more of the light sources are enclosed in a die, then the die may have appropriate sections that are transparent or translucent to allow light from the lights source(s) to pass through.

With further reference to FIG. 3A, the reflector 304 can have one or more apertures 305 for passing light from a light source 308 to refractor 302. In the embodiment depicted in FIGS. 1, 2, 3A, 4-5 and 7, the reflector 104 (in FIG. 1) is configured with a V-shape having first and second arms 304*a* spread at a desired included angle α. In exemplary embodiments the included angle, α, may be 100 degrees; of course other included angles may be used as suitable. In the depicted embodiment, the first and second arms are straight, but could be replaced with curved, stepped or other known reflector configurations to facilitate a desired light distribution, Various surface treatments are also contemplated to provide desired reflectance.

Each aperture 305 may be configured (e.g., sized and/or shaped) as desired. For example, a single aperture 305 may be sized to have a length (measured along the vertex of the reflector 304) that is or is substantially the length of PCB 312 so as to provide an opening at the vertex of the reflector 304 at each light source along the length of the PCB 312. In other embodiments, multiple apertures (a plurality of) 305 may be disposed in a desired configuration, e.g., linearly with a constant or varying linear density (e.g., one every foot, one every light source, one every two light sources, etc.). Each individual aperture 305 may have a shape (e.g., of its perimeter) that is selected as desired. For example, an aperture may be elliptical in shape with any degree of eccentricity, circular, rectangular, irregular (any shape) square, triangular, etc.

In exemplary embodiments, the central lens portion 303 of refractor 302 may be positioned to receive light from a light source 308 by way of aperture 305. The luminaire 300A may be configured such that all light passing through the aperture 305 passes through the central lens portion 303. Alternatively, luminaire 300A may be configured such that only a portion of the light passing through the aperture 305 passes through the central lens portion 303. In yet a further alternative embodiment, the luminaire may comprise a refractor 302 with no central lens portion 303, in which case the refractor 302 is of the substantially the same thickness in all portions through which light from the light source 308 travels. Refractor 302 may have one or more lateral faces 307, as shown, which may have varying thicknesses to direct the light passing therethrough, or be of constant thickness to serve primarily as protection for the elements of the luminaire 300A. Refractor 302 may optionally have inwardly directed members 318, as shown. In one embodiment not depicted, optional inwardly directed member 318 may be configured so as to clamp the PCB 312 to the frame 314 when the refractor 302 is connected to the frame 314 as depicted in FIG. 3A. In order to facilitate clamping of the PCB 312 in this manner, the configuration of the optional inwardly directed member 318 must take into consideration no only the configuration of the frame 314, but also the configuration of the PCB 312. In yet another alternative embodiment, not depicted, the optional inwardly directed member 318 may be configured so as to clamp down on top of the mounting structure 306, providing additional stability to the mounting structure 306 and the reflector 304 held by the mounting structure 306.

Refractor 302 may include a central face 315 in which the central lens portion 303 resided, if a central lens portion 303 is present. Central face 315 may be relatively or substantially flat in some embodiments, though it may comprise one or more curvatures or other shapes. The central face 315 may have a desired width, shown by "a," and may be of any length suitable for the luminaire 300A and its application. For example, the length of face 315 may be 3 ft., 6 ft., 9 ft., etc. In some embodiments, central face 315 may have a diffusive surface 316 on the interior or exterior thereof, which may facilitate uniformity of light intensity and distribution. The diffusive surface 316 can span the entirety of central face 315 or portions of central face 315 as needed, e.g., as indicated by width "b" in the FIG. 3A. In exemplary embodiments, diffusive surface 316 can be or include a diffusive acrylic layer approximately 8 mils thick (0.008 in.) covering a desired width of the central face 315, e.g., 0.7 inch. In one embodiment, the diffusive surface 316 can be provided by co-extruding refractor 302 to comprise a layer of diffusive material (not depicted) at the diffusive surface 316. In one example, the diffusive layer is 8 mils thick and comprised of an acrylic sold under the trade name Acrylite® 8Ndf23 at the outermost surface of the refractor 302 at the central face 315. In an alternative embodiment, the diffusive surface 316 can be provided by applying a film of diffusive material to the outside of central face 315. For example, a length of Scotch tape or other tape may be applied to the outer surface of the central face 315. In exemplary embodiments, luminaire 300A may be symmetric with respective to a plane intersecting midline z, as shown.

In operation, light source 308 can produce light, which may emanate from the light source 308 in a three-dimensional distribution pattern, e.g., a hemisphere of 271 steradians of solid angle, or a cone of other given included solid angle, etc. Of the light constituting this distribution, some may travel directly out of the refracting element 302, for example, through lateral face 307, as shown by representative rav trace R1. Some of the light from the light source 308 may be reflected by reflective element 304 and then pass through refractive element 302 as shown by representative ray trace R2. Still, another portion of the light from light source 308 may pass through aperture 305 and then through refractive element 302, e.g., through contoured portion 303, as shown by representative ray trace R3. Ray traces R1-R3 are merely representative, and other optical paths may occur, e.g., ones including total internal reflection in accordance with Snell's law.

Refractor 302 may be made from any suitable transparent, substantially transparent, and/or translucent material, e.g., glass, Lexan, or acrylic such as sold under the trade name Optix® CA-1000E, or suitable functional equivalent. The material used for the refractor 302 may have any suitable clarity. In exemplary embodiments, the material may be about 85% transmissive, though higher values, e.g., 90% or higher, may be preferred. The diffusive surface 316 or the central face 315 and exemplary materials therefore are discussed above. Any suitable reflective material may be used for reflector 304. Examples include, but are not limited to, specular aluminum, chromed steel, aluminized or aluminum-coated plastic, painted plastic, and the like. In exemplary embodiments, a specular aluminum sheet is used that is about 95% reflective; of course, other values of reflectivity (e.g., 70%, 85%, 90% or thereabouts) may be used or implemented for a reflective element. Alanod Miro—4400 GP is considered suitable. If the reflector 304 is comprises of a metal, the reflector can be constructed by one or more stamping operations to form the apertures 305 and one or more bending operations to form the desired V-shape. It is further noted that the reflector 304 shape need not be an absolute V. Rather various variations and deviations from the absolute V, such as curved legs extending from the vertex, are contemplated.

In an exemplary embodiment, light source(s) 308 may include one or more LEDs suitable for the light distribution and intensity necessary for the application. The light sources 308 could be LEDs made commercially available by Osram Opto Semiconductor, Model Oslon LUW CP7P-LXLY-7P7E. Other suitable lights sources 308 may include, but are not limited to, Cree XPEWHT-01-0000-00EC, Philips LumiLEDS Rebel LXML-PWN1-0100, or suitable equivalent. The length (e.g., into or out of the plane of FIG. 3A) of an aperture may be about 0.5 inches in exemplary embodiments. The approximate range of angular rays emanating from the apertures 305 may be 45 degrees, plus or minus five degrees, for exemplary embodiments.

In exemplary embodiments, luminaire 300A may have a rectangular shape in plan view and may be configured for retrofitting into a lighting application that previously included fluorescent lighting. Of course, luminaire 300A may have other shapes in plan view, e.g., circular, oval, square, etc.

For use in illuminating a desired area, the luminaires of the present disclosure may be mounted to a structure or surface by any suitable mounting devices, structures, fasteners, or the like.

Figure 3B:
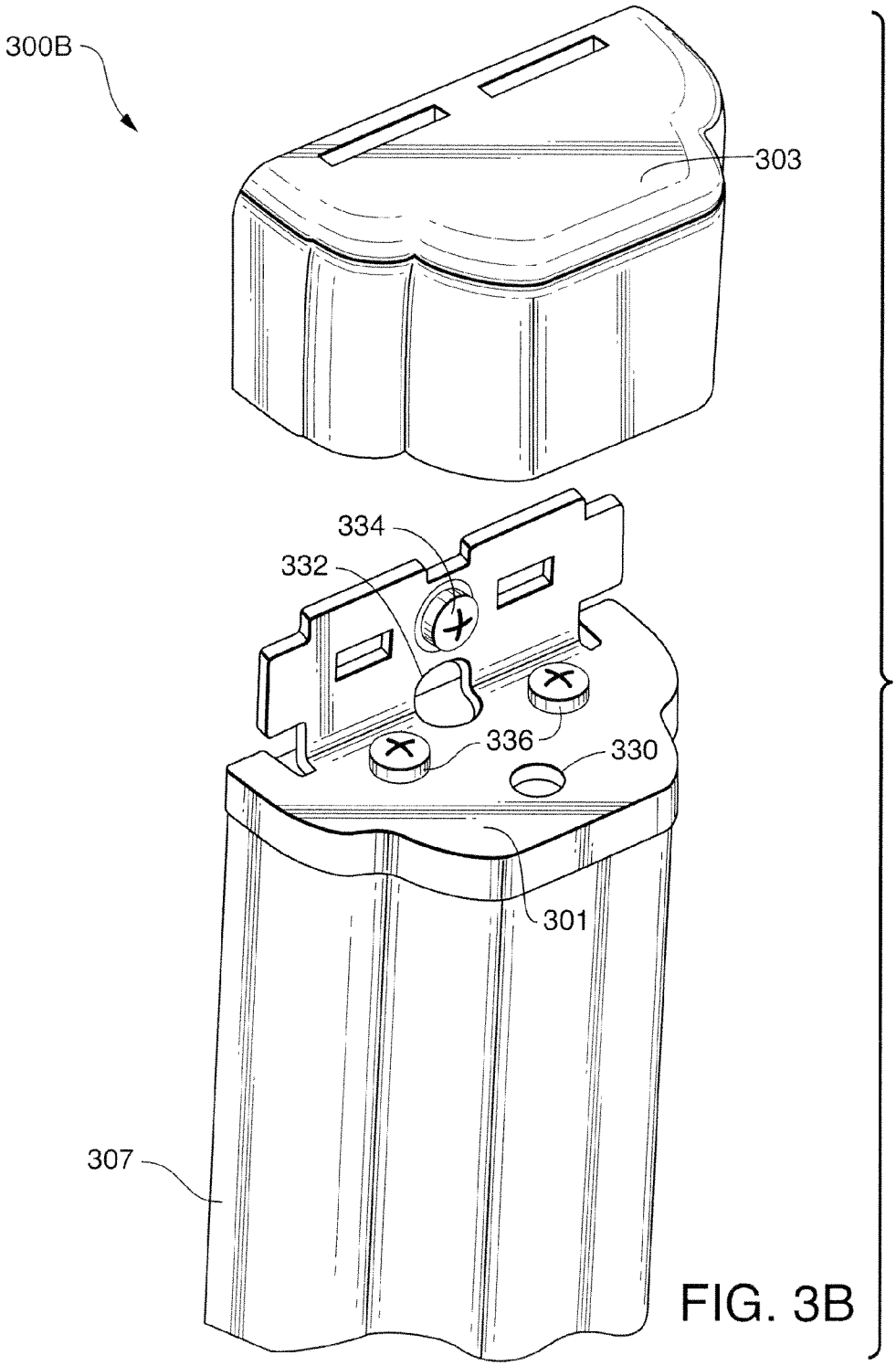
FIG. 3B depicts a perspective view of an end of one exemplary embodiment of a luminaire, both in accordance with the present disclosure.

FIG. 3B depicts a perspective view of a portion of a luminaire 300B, similar to luminaire 300A of FIG. 3A, with a mounting bracket 301 for mounting the luminaire to a structure, e.g., an underlying mullion, support structure, or the like. The mounting bracket 301 may be formed from any suitable material, e.g., sheet metal, plastic, or the like. The end cap 301 may include one or more holes or apertures. For example, apertures 330 and 332 may be present for accommodating a power chord. For further example, one or more apertures may be formed in the end cap for use with fasteners, e.g., screws, as shown by 334 and 336. An end cap 303 may be present to cover the mounting bracket 301.

For operation, in some applications, a power cable/chord from the luminaire 300B may be run through a hole (e.g., 332) in the mounting bracket 301 out the back and through a hole formed into an underlying structures such as a cooler mullion to which the luminaire 300B is to be mounted. The other end (not shown) of the luminaire 300B may optionally include a hole, e.g., a breather hole for venting the interior of the fixture. The cooler mullion can act as a passageway for the power cable and possible mounting location of a related power supply. The luminaire 300B may be attached (e.g., screwed) into place, e.g., on the cooler mullion, top and bottom. The end cap (e.g., a molded plastic cap) 303 may be snapped over this mounting bracket 301 to hide the screws, cables, etc. The back of the luminaire 300B and the cap 303 may rest flush against an underlying structure, e.g., cooler mullion. In this way, all potential crevices may be hidden or minimized, e.g., for NSF compliance.

Figure 4:
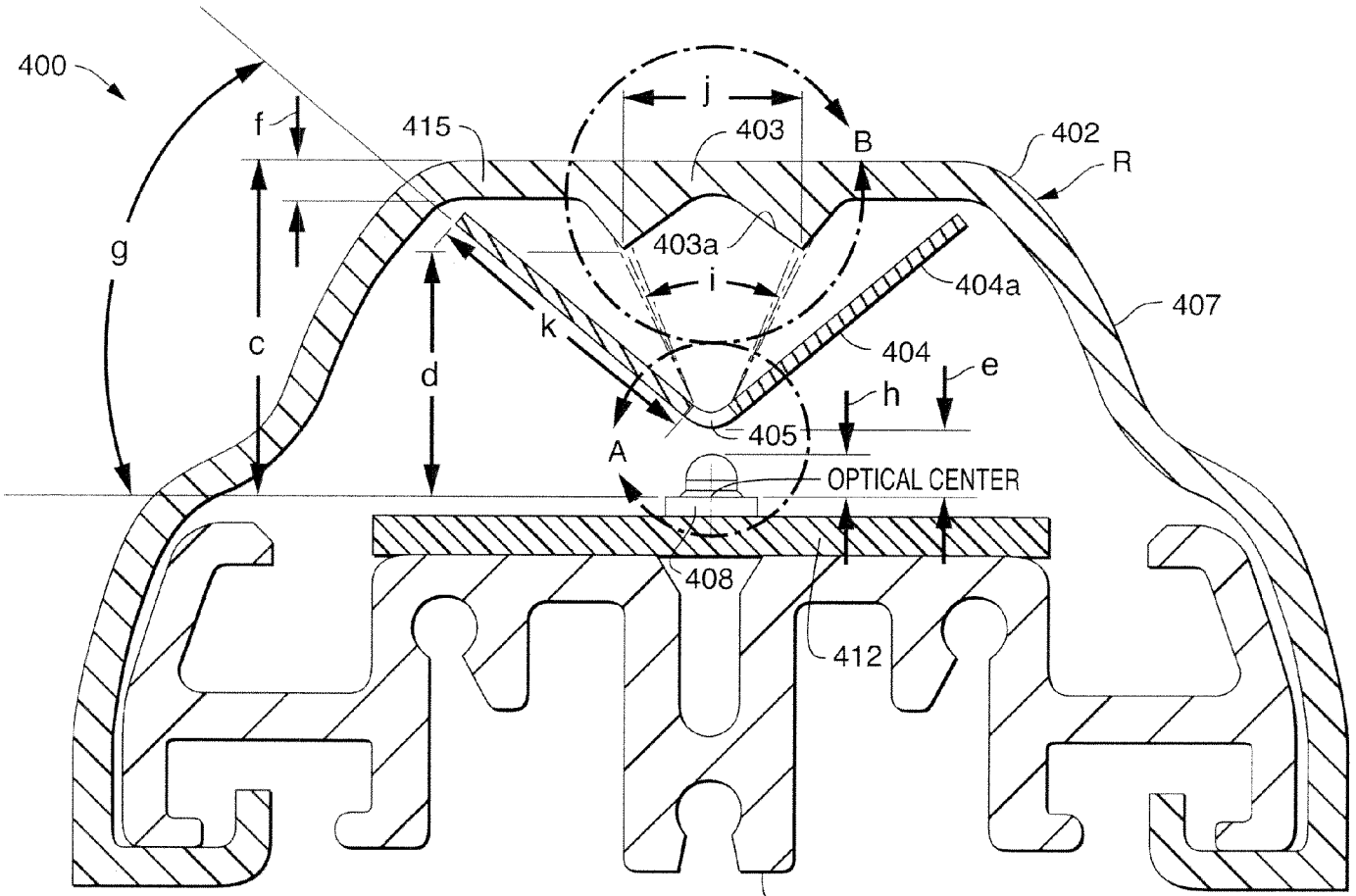
FIG. 4 depicts a cross section view of an example of a luminaire, showing variable design parameters.

FIG. 4 depicts a cross section view of a further example of a luminaire 400, showing variable design parameters that may be selected or specified as desired, e.g., for a particular installation or application. As shown, luminaire 400 may include a refractor 402 with a central lens portion 403 having a curved surface 403*a*. Luminaire 400 can also include a reflector 404. Reflector 404 may have one or more lateral reflective faces 404*a*. Reflector 404 may have one or more apertures 405 that are configured to allow light to pass through the reflective element 404. Apertures 405 may be holes, e.g., as drilled or stamped through reflective element 404, or may be portions of reflective element that are transparent or translucent instead of reflective, for example, portions that are not painted with reflective paint. Reflector 404 may be held by a support member (not depicted in FIG. 4). One or more light sources 408 may be present and configured adjacent to aperture 405, e.g., disposed on support surface or PCB 412, as shown. The refractor 402 may also have one or more lateral faces 407, as shown. For some applications, lateral face(s) 407 may have a desired radius of curvature "R." For example, lateral faces 407 may have a radius of curvature relative to the optical center of one or more light sources 408. R may have any suitable value (e.g., 0.5 in., 0.590 in., 1.0 in., etc).

For luminaire 400, a number of design parameters (c-j) are shown, which may be selected as desired for various applications. The design parameters shown include the following: (c)—the distance or height between the top of the refractive element 402 at the central face 415 and the optical center 408; (d)—the distance or height between the lowest portion of the curved surface 403*a* of the central lens portion 403; (e)—the distance or height between the optical center of the light source 408 and the proximal portion of the apex of the reflector 404 at the aperture 405; (f)—the thickness of the central face 415; (g)—angle between the faces 404*a* of the reflector 404 and the horizontal reference plane; (h)—the distance or height between the optical center of the light source 408 and the distal or top portion of the optical source housing, e.g., LED package; (i)—angular range of rays emanating from aperture (either solid angle or 2D angle); (j)—distance or diameter across trench or circle formed by the curved surface 403*a* of the central lens portion 403; and (k)—distance or length of lateral reflective surface(s) 404*a*.

Figure 5:
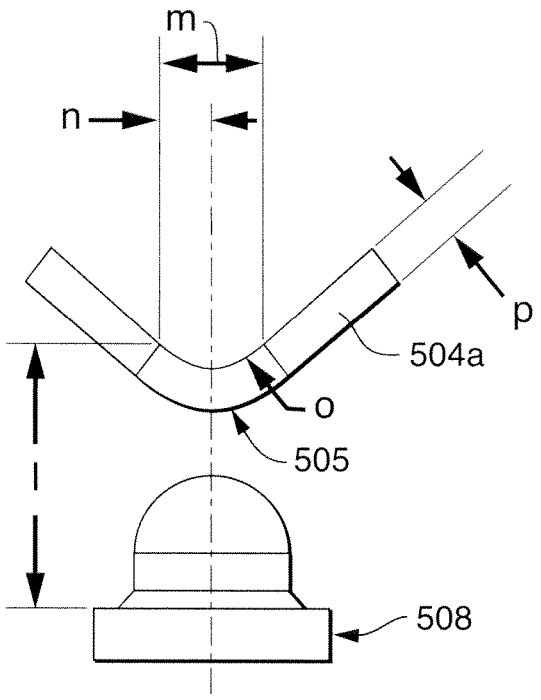
FIG. 5 is a cutout view of detail A of FIG. 4.
Figure 6:
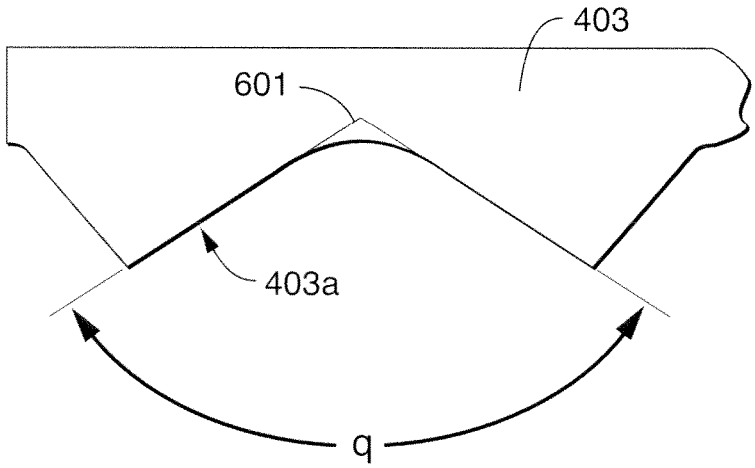
FIG. 6 is a cutout view of detail B of FIG. 4.

FIG. 5 is a cutout view of detail A of FIG. 4, while FIG. 6 is a cutout view of detail B of FIG. 4. FIG. 5 shows the following design parameters: (l)—height between optical center of light source 408 and the aperture 405, on the distal side, away from light source 408; (m)—width of aperture 405, on the distal side, away from light source 408; (n)—half-distance or radius of aperture 405, on distal side, away from light source 408; (o)—radius of curvature of fillet between lateral reflective faces 404*a*; and (p)—thickness of lateral reflective faces 404*a*.

FIG. 6 shows the central lens portion 403 with a curved surface 403*a* that is symmetrical about a center line. Curved surface 403*a* may subtend any suitable angle, "q" for various applications. In exemplary embodiments, the profile of curved surface 403*a* may be an elliptical profile, e.g., approximated by the curve $y=0.706x^{0.664}$; other curves and and/or profiles may of course be used. For the profile of curved surface 403*a*, two flats may be angled toward a vertex, e.g., vertex 601 in FIG. 6 finished by a smooth curve or fillet. Of course, any other desired profile may be used for curved surface 403*a*, e.g., saw-tooth pattern, sinusoidal, etc.

In an exemplary embodiment, luminaire 400 as shown in FIGS. 4-6 may have the following values for design parameters (c-p):

| | |
|---|---|
| c | 0.450" |
| d | 0.334" |
| e | 0.092" |
| f | 0.050" |
| g | 40° |
| h | 0.062" |
| i | 45° |
| j | 0.240" |
| k | 0.407" |
| l | 0.122" |
| m | 0.048" |
| n | 0.024" |
| o | R = 0.03" |
| p | 0.020" |
| q | 112° |

Figure 7:
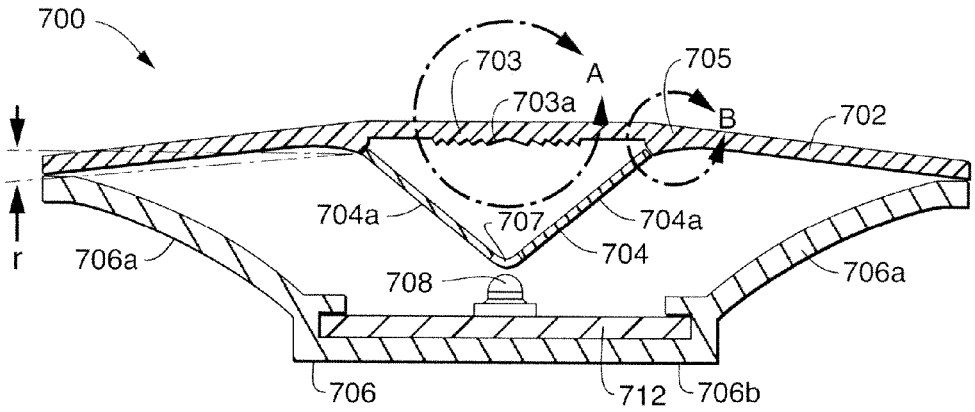
FIG. 7 depicts a cross sectional view of a further embodiment of a luminaire, in accordance with the present disclosure.
Figure 8:
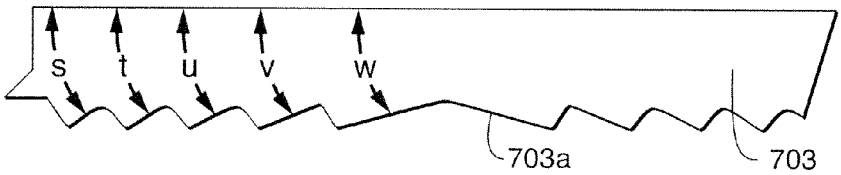
FIG. 8 is a cutout view of detail A of FIG. 7.
Figure 9:
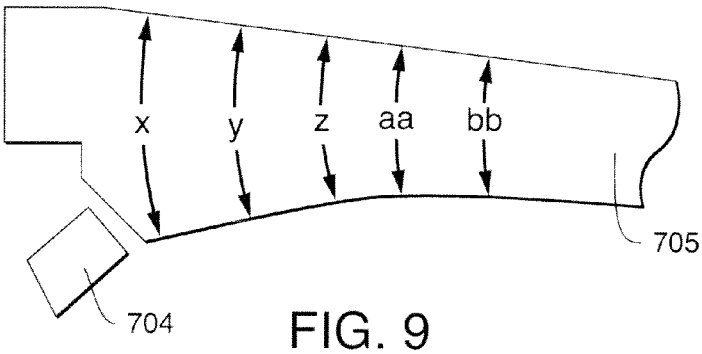
FIG. 9 is a cutout view of detail B of FIG. 7.

FIG. 7 depicts a cross sectional view of a further embodiment of a luminaire 700, in accordance with the present disclosure. FIG. 8 is a cutout view of detail A of FIG. 7, while FIG. 9 is a cutout view of detail B of FIG. 7. In operation, luminaire 700 can distribute light similarly to luminaire 400 of FIG. 4.

As shown, luminaire 700 may include a refractor 702 and a reflector 704. Refractor 702 may include a central lens portion 703 that has a profiled surface 703*a*. Reflector 704 may include one or more lateral reflective faces 704*a*. The included angle between the lateral reflective faces 704*a* may be selected as desired for the sought light distribution. For example, the angle may be about 100 degrees, about 90 degrees, about 95 degrees, about 110 degrees, 80 degrees, about 105 degrees, etc. Luminaire 700 may also include a frame element 706 with one or more secondary reflective surfaces 706*a*, as indicated. Frame element 706 may also have a base 706*b*, as shown. Reflective element 704 may include one or more apertures 707. Aperture(s) 707 may be configured adjacent to, and pass or receive light from, one or more light sources 708. Light source(s) 708 may be positioned on a support surface 712, e.g., a PCB.

With continued reference to FIG. 7, refractor 702 may include a central lens portion 703 having a profiled surface 703*a*. The profiled surface 703*a* may have any desired surface profile. In exemplary embodiments, the contour or shape of profiled surface 703*a* may facilitate even or roughly even light intensity distribution of light outside of the luminaire 700 in a desired area or region. Examples include but are not limited to concentric circles or ovals or ellipses, with a saw tooth or curved profile in cross-section. Refractive element 702 may also include a shaped portion 705 that has a varying thickness in cross section. As shown in FIG. 7, the shaped portion may 705 facilitate reception of the reflective element 704 by the refractive element 702.

As further shown in FIG. 7, refractor 702 may be shaped to provide a viewing angle "r" of desired size or range of sizes. For example, in exemplary embodiments, refractor 702 may have a bend at or near shaped portion 705 such that the viewing angle, r, is 5° or approximately 5°; which may facilitate hiding, or preventing direct viewing of, light source 708 by people in an area or region outside of the luminaire 700.

In exemplary embodiments, luminaire 700 has a rectangular shape in plan view and may be configured for retrofitting into a lighting application that previously included fluorescent lighting. Of course, luminaire 700 may have other shapes in plan view, e.g., circular, oval, square, etc.

In an exemplary embodiment, the lateral faces 104*a* are 0.517 inches long, the viewing angle is 7 degrees, base 706*b* is 1.136 inches wide, the secondary reflective surfaces 706*a* have a radius of curvature of 1.250 inches, and overall frame width is 2.821 inches, with a height to the top of the frame of 0.490 inches, while the overall height of the luminaire is 0.635 inches.

In another exemplary embodiment, luminaire 700 as shown in FIGS. 7-9 may have the following values for design parameters (r-bb):

| | |
|---|---|
| R | 5° |
| S | 35° |
| T | 32° |
| U | 27° |
| V | 22° |
| W | 15° |
| X | 22° |
| Y | 18° |
| Z | 13° |
| aa | 8° |
| bb | 4° |

The LEDs of this exemplary embodiment can be of any kind, color (e.g., emitting any color or white light or mixture of colors and white light as the intended lighting arrangement requires) and luminance capacity or intensity, preferably in the visible spectrum. Color selection can be made as the intended lighting arrangement requires. In accordance with the present disclosure, LEDs can comprise any semiconductor configuration and material or combination (alloy) that produce the intended array of color or colors. The LEDs can have a refractive optic built-in with the LED or placed over the LED, or no refractive optic; and can alternatively, or also, have a surrounding reflector, e.g., that re-directs low-angle and mid-angle LED light outwardly. In one suitable embodiment, the LEDs are white LEDs each comprising a gallium nitride (GaN)-based light emitting semiconductor device coupled to a coating containing one or more phosphors. The GaN-based semiconductor device can emit light in the blue and/or ultraviolet range, and excites the phosphor coating to produce longer wavelength light. The combined light output can approximate a white light output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light (or another desired color). In yet another suitable embodiment, colored LEDs are used, such are phosphide-based semiconductor devices emitting red or green light, in which case the LED assembly produces light of the corresponding color. In still yet another suitable embodiment, the LED light board may include red, green, and blue LEDs distributed on the printed circuit board in a selected pattern to produce light of a selected color using a red-green-blue (RGB) color composition arrangement. In this latter exemplary embodiment, the LED light board can be configured to emit a selectable color by selective operation of the red, green, and blue LEDs at selected optical intensities. Clusters of different kinds and colors of LED is also contemplated to obtain the benefits of blending their output.

Each PCB, e.g., 212 of FIG. 2, can include an onboard driver to run the light sources, e.g., LEDs, with a desired current. For example, a current suitable for an LED may be used. For example, a representative current range could include, but is not limited to about 250 mA to about 800 mA; one exemplary current is about 350 mA and another is 600 mA. A circuit board can have a bus, e.g., a 24V DC bus, going from one end to the other. Other voltages may of course be used for a bus. Any suitable number of suitable LEDs can be disposed on a light strip board. In one illustrative example, two (2) Rebel LEDs (LUXEON® Rebel LEDs as made commercially available by the Philips Lumileds Lighting Company)—per foot, operational at 80 Lumens minimum may be employed with the luminaire of the present disclosure. Other suitable LEDs or alternative light sources and output values may be used within the scope of the present disclosure.

In exemplary embodiments, a lens or refractive element may be made of an extrusion of polycarbonate or acrylic. Such polycarbonate or other plastic may be selected as desired and may possess a desired degree of transparency (and, therefore, opaqueness) and may have a desired color.

In further embodiments, the formation of at least one support member can include forming a circuit board supporting face in the support member that is configured and arranged to support the circuit board (and attached light sources) in a desired orientation, e.g., as when the related assembly is placed in a retrofit application. A visual cutoff shield may also be mounted to a support member for some applications.

Accordingly, lighting assemblies and luminaires according to the present disclosure can distribute light from one or more light sources in desired ways. Exemplary embodiments of lighting techniques according to the present disclosure can be used to retro-fit existing lighting assemblies and applications that were initially constructed to utilize fluorescent lighting. Such lighting according to the present disclosure can afford reduced energy, maintenance, and installation costs, as well as reduced installation time when compared to existing techniques. As described previously, exemplary embodiments of the present disclosure may utilize LEDs as light sources.

While certain embodiments have been described herein, it will be understood by one skilled in the art that the methods, systems, and apparatus of the present disclosure may be embodied in other specific forms without departing from the spirit thereof. For example, while aspects and embodiments herein have been described in the context of retrofit applications for refrigerated display cases, the present disclosure is not limited to such; for example, embodiments of the present disclosure may be utilized generally for any light distribution applications.

Accordingly, the embodiments described herein, and as claimed in the attached claims, are to be considered in all respects as illustrative of the present disclosure and not restrictive.

What is claimed is:

1. A luminaire comprising:

a first light source and a second light source;

an elongated reflective element defining a first aperture located adjacent to the first light source and configured to pass a first portion of light received from the first light source through the first aperture in a first direction and reflect a second portion of light received from the first light source in a second direction;

the elongated reflective element defining a second aperture located adjacent to the second light source and configured to pass a first portion of light received from the second light source through the second aperture in a third direction and reflect a second portion of light received from the second light source in a fourth direction; and a refractive element configured to receive and transmit the first and second portions of light.

2. The luminaire of claim 1, wherein the third direction is approximately the same as the first direction.

3. The luminaire of claim 1, wherein the reflective element comprises a V-shaped cross section.

4. The luminaire of claim 3, wherein the included angle of the V-shaped cross section is about 100 degrees.

5. The luminaire of claim 1, wherein the refractive element comprises a contoured portion configured to receive the first portion of light.

6. The luminaire of claim 5, wherein the contoured portion has a V-shaped cross section.

7. The luminaire of claim 5, wherein the contoured portion has a parabolic cross section.

8. The luminaire of claim 6, wherein the included angle of the V-shaped cross section is about 112 degrees.

9. The luminaire of claim 7, wherein the included angle of the parabolic cross section is about 112 degrees.

10. The luminaire of claim 1, wherein the refractive element comprises a lateral face.

11. The luminaire of claim 1, wherein the refractive element comprises a pair of opposed lateral faces.

12. The luminaire of claim 1, further comprising a frame configured to hold the light sources.

13. The luminaire of claim 12 further comprising a reflector mounting clip connecting the elongated reflective element to the frame and locating the first aperture adjacent to the first light source, the reflector mounting clip comprising first and second receiving legs, each receiving leg defining a receiving slot receiving the elongated reflective element.

14. The luminaire of claim 12, further comprising a reflector mounting clip connecting the elongated reflective element to the frame and locating the first aperture adjacent to the first light source, the refractive element comprising a inwardly directed member holding the mounting structure to the frame.

15. The luminaire of claim 1, wherein the first light source is a LED.

16. A luminaire comprising:

a first light source for emitting light and a second light source for emitting light;

an elongated reflector having a first side and a second side and defining a first aperture extending from the first side to the second side and defining a second aperture extending from the first side to the second side, the reflector configured and situated such that:

a first portion of the light emitted by the first light source passes through the first aperture and a first portion of the light emitted by the second light source passes through the second aperture; and a second portion of the light emitted by the first light source is reflected by the first side of the reflector and a second portion of the light emitted by the second light source is reflected by the first side of the reflector.

17. The luminaire of claim 16 wherein the first portion of light emitted by the second light source passes through the second aperture to a refractive element.

18. The luminaire of claim 16 wherein the reflector is generally V-shaped defining a vertex and the luminaire is configured such that the first light source is situated adjacent to the vertex of the V-shaped reflector.

19. The luminaire of claim 16 wherein the reflector is generally V-shaped defining a vertex and the luminaire is configured such that the first light source is located adjacent the first aperture, which is defined approximately at the vertex of the V-shaped reflector.

20. The luminaire of claim 16 wherein the first light source is an LED.

21. The luminaire of claim 16 wherein a third portion of light emitted by the light source does not pass through the reflector and is not reflected by the first side of the reflector.

22. The luminaire of claim 17 further comprising a reflector mounting clip connecting the elongated reflector to a frame and locating the first aperture adjacent to the first light source, the reflector mounting clip comprising first and second receiving legs, each receiving leg defining a receiving slot receiving the elongated reflector.

23. The luminaire of claim 16 further comprising a refractor lens having a central lens portion configured to receive at least a portion of the first portion of light emitted by the first light source.

24. The luminaire of claim 23 wherein the central lens portion is contoured to refract light.

* * * * *